US006527467B2

(12) United States Patent
Betts

(10) Patent No.: US 6,527,467 B2
(45) Date of Patent: Mar. 4, 2003

(54) EXPANSION JOINT

(75) Inventor: Kenneth H. Betts, Thornbury (CA)

(73) Assignee: C/S Construction Specialties Limited, Mississauga (CA)

( * ) Notice: Subject to any disclaimer, the term of this patent is extended or adjusted under 35 U.S.C. 154(b) by 0 days.

(21) Appl. No.: 09/793,925

(22) Filed: Feb. 28, 2001

(65) Prior Publication Data

US 2002/0054785 A1 May 9, 2002

(30) Foreign Application Priority Data

Nov. 6, 2000 (CA) ..... 2325220

(51) Int. Cl.[7] ..... F16D 1/12; F16C 11/00

(52) U.S. Cl. ..... 403/122; 52/393

(58) Field of Search ..... 403/122, 119, 403/164, 165, 388, 384, 410, 68, 66, 78, 79, 81, 76, 93; 238/310, 318, 323, 151, 166, 305, 46, 47, 29; 404/47, 53, 54, 57, 56, 68, 69, 55; 52/465, 459, 393, 394, 395, 402, 396.04, 466, 467, 469, 470, 472, 573.1, 396.05

(56) References Cited

U.S. PATENT DOCUMENTS 3,650,341 A * 3/1972 Asmussen ..... 180/5 R
5,400,559 A 3/1995 Nicholas ..... 52/396.05
5,875,598 A 3/1999 Batten et al. ..... 52/396.01

OTHER PUBLICATIONS

Brochure entitled: "C/S Expansion Joint Systems—Elastomeric Seals, Compression Seals & Seismic Joint Covers 2000"—Products and Systems Designed Exclusively for Parking Structures by C/S Group, Mississauga, Ontario, Canada.

Brochure entitled: "C/S Expansion Joint Covers—Interior & Exterior • Thermal • Seismic 1999"—Over 3 Miles of C/S Expansion Joints at Chek Lap Kok Airport by C/S Group, Mississauga, Ontario, Canada.

* cited by examiner

*Primary Examiner*—Christopher J. Novosad
(74) *Attorney, Agent, or Firm*—Bereskin & Parr

(57) ABSTRACT

An expansion joint for a parking structure includes first and second rails for mounting on adjacent slabs at opposite sides of a gap therebetween and a cover plate that overlies the rails and covers the gap while permitting relative movement between the slabs. A series of turnbars are pivotally coupled to the underside of the cover plate using ball and socket joints so that lateral loads imposed on the cover plate are transmitted directly into the turnbars, minimizing the risk of shear failure between the cover plate and the turnbars. At the same time, the ball and socket joints allow the cover plate and turnbars to tip with respect to one another. The turnbars have spherical end portions that are received in complimentary channels in the respective rails so that the turnbars maintain the cover plate centered over the gap.

9 Claims, 2 Drawing Sheets

EXPANSION JOINT

FIELD OF THE INVENTION

This invention relates to expansion joints for structures that carry vehicular traffic. The invention has been devised primarily in the environment of parking structures but may find application in other similar structures, for example, bridges.

BACKGROUND OF THE INVENTION

Parking structures typically are constructed using reinforced concrete slabs to provide a traffic surface. The individual slabs are sized and spaced from one another to allow for relative movement between the slabs, in particular to accommodate expansion and contraction due to temperature changes. In some geographic areas, it is also necessary to accommodate relative movement caused by seismic events.

Expansion joints are used to cover the gaps between the slabs and prevent infiltration of moisture and debris. In a parking structure, the expansion joints must also be designed to withstand repeated cyclical movement caused by vehicles travelling over the joints. An expansion joint in a high-traffic area such as an entrance or exit ramp must be designed to withstand millions of cycles over its lifetime.

Another criterion is the ability to withstand lateral shear forces as vehicles move over the joints, and in particular lateral forces imposed on the joints when vehicles brake and/or accelerate with their wheels on the expansion joint.

In an effort to address these criteria, many different expansion joint designs have evolved, ranging from elastomeric seals that attempt to fill the gap, to cover plates that extend over and cover the gap. Typically, a cover plate is located in shallow recesses that are formed in the respective slabs on opposite sides of the gap so that the top surface of the cover plate is generally flush with the top surfaces of the slabs. The cover plate overlies a pair of rails that are bolted to the slabs in the respective recesses. A trough or water stop is provided in the gap below the cover plate to catch any moisture that might penetrate between the cover plate and the rails.

The cover plate is self-centering with respect to the gap by virtue of a series of turnbars that are pivotally coupled to the underside of the plate and engaged at their ends in slots that extend longitudinally of the rails. As the slabs move with respect to one another, changing the width of the gap, the turnbars angle more or less acutely with respect to the walls of the gap, maintaining the cover plate centred.

A drawback to this type of joint is that it is relatively vulnerable to lateral loadings, for example, when a vehicle brakes or accelerates with its wheels on the cover plate. Pivot pins or bolts coupling the turnbars to the cover plate may bend or even shear off.

Another weakness of this type of expansion joint is vulnerability to water infiltration around the rails that are mounted on opposing faces of the slabs. Typically, each rail is an extrusion that is bolted in place in a recess in the relevant slab. The extrusion is then "back filled" with elastomeric concrete which bonds to the extrusion and to the slab and is intended to seal out moisture. A difficulty with some expansion joints is that the extrusions have profiles that include undercut areas or "pockets" that can be difficult to fill with elastomeric concrete. Concrete is a highly viscous liquid that is poured into place and allowed to set. The highly viscous nature of the material makes it difficult to ensure that undercut recesses in the extrusion are completely filled. If they are not, the elastomeric concrete may tend to shrink or pull away from the extrusion and/or slab, creating areas for water infiltration.

SUMMARY OF THE INVENTION

An object of the present invention is to provide improvements in expansion joints intended to address at least some of these drawbacks.

According to one aspect of the invention there is provided an expansion joint for installation across a gap between adjacent slabs of a structure intended to carry vehicular traffic. The joint includes first and second rails for mounting on the respective slabs at opposite sides of the gap and a cover plate dimensioned to overlie the respective rails and cover the gap while permitting relative movement between slabs. A plurality of turnbars are carried by the cover plate and coupled to the respective rails for maintaining the cover plate centered over the gap. Each turnbar has end portions that are coupled to the respective rails for sliding movement longitudinally of the rails in response to relative lateral movement of the slabs. Each turnbar also defines a pivot axis between its ends about which the turnbar turns with respect to the cover plate in response to lateral movement of the slabs. Each turnbar is connected to the cover plate by coupling means that includes socket on one of the turnbar and cover plate and the rotational coupling element on the other. The coupling element and socket are complimentarily shaped to allow turning of the turnbar with respect to the cover plate about the said axis while transferring lateral loads imposed on the cover plate in use directly to the turnbar and into the relevant slab via the rail mounted on the slab.

Preferably, the coupling between each turnbar and the cover plate is a ball and socket coupling so that the cover plate and turnbar can also tip to some extent with respect to one another. On the other hand, in applications in which tipping is unlikely to occur, the coupling element could, for example, be of cylindrical form. Most importantly, the coupling should provide a solid connection between the cover plate and turnbar so that lateral loads imposed on the cover plate are transferred directly to the turnbar and any propensity for the cover plate to move laterally with respect to the turnbars is minimized.

Preferably, the end portions of each turnbar are provided by formations that are enlarged with respect to the main, elongate body of the bar that extends between the end portions. The formations preferably are in line with that main body of the bar so that forces imposed on the bar are transmitted directly to the enlarged end portions. The rails in turn preferably define undercut slots that are complimentary to the profile of the enlarged end portions of the bar and that relatively closely accommodate those formations so that there is minimum free play between the bar and the rails. Again, the objective should be to transfer directly to the rails and, from there to the slabs lateral forces that are imposed on the plates and transferred from there to the turnbars. There should be minimal free play between these components.

Another aspect of the invention relates to the profile shape of the rail of the expansion joint.

BRIEF DESCRIPTION OF DRAWINGS

In order that the invention may be more clearly understood, reference will now be made to the accompanying drawings which illustrate a particular preferred embodiment of the invention, and in which.

DESCRIPTION OF PREFERRED EMBODIMENT

Figure 1:
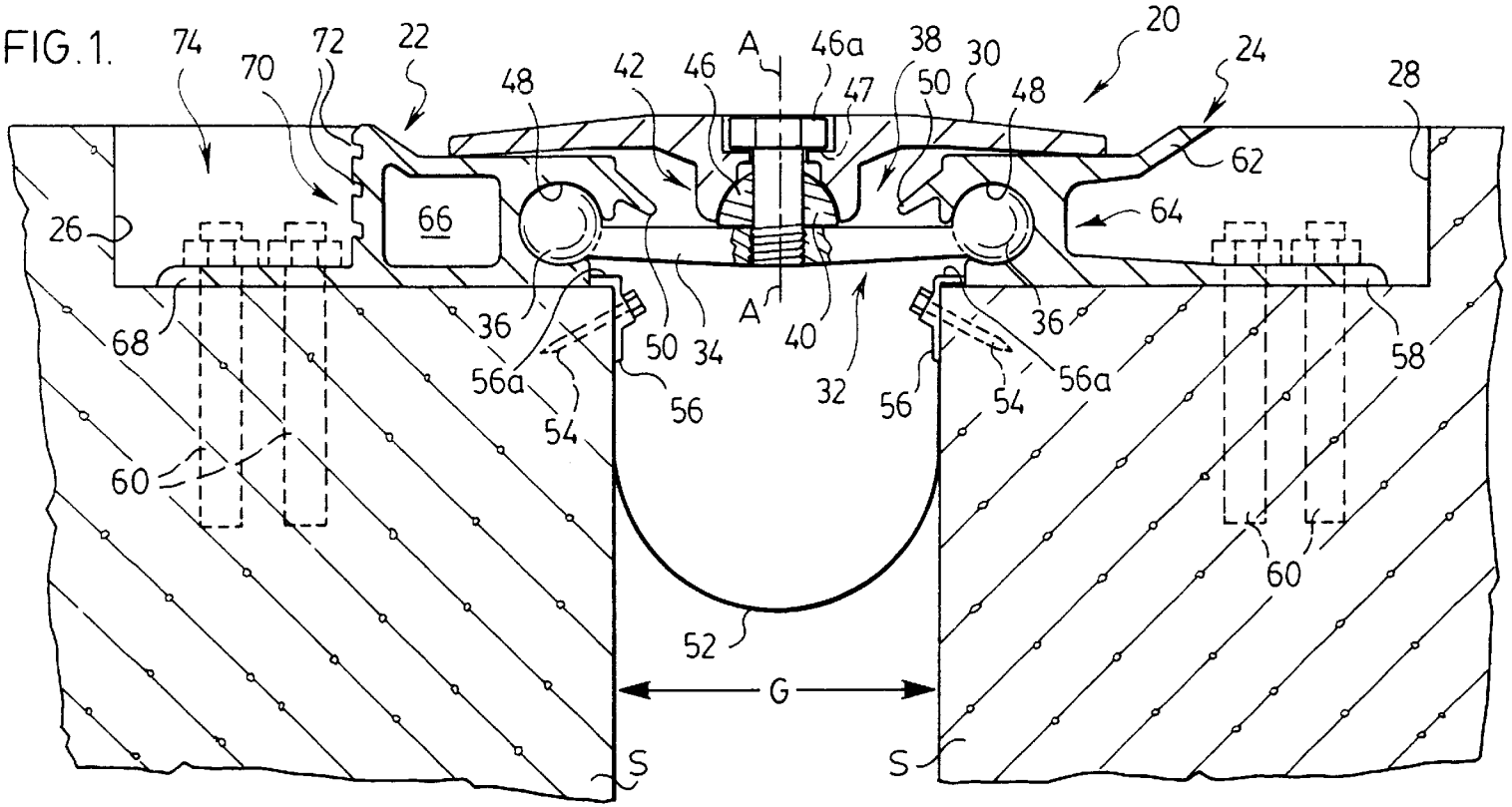
FIG. 1 is a vertical sectional view through an expansion joint in accordance with a preferred embodiment of the invention.

Referring first to FIG. 1, an expansion joint is shown generally at 20 installed across a gap "G" between adjacent reinforced concrete slabs "S" of a parking structure. The joint includes first and second rails 22, 24 that are mounted in respective recesses or rabbets 26, 28 in the two slabs adjacent respectively opposite sides of the gap. A cover plate 30 is dimensioned to overlie the respective rails 22 and 24 and cover the gap G while permitting relative movement between the slabs S. The slabs may move laterally with respect to one another (narrowing or widening the gap G or in the longitudinal direction of the gap) and vertically with respect to one another. Joint 20 must be capable of accommodating all of those movements, including simultaneous lateral and vertical movement.

Each of the rails 22, 24 and the cover plate 30 is an aluminum extrusion of a length appropriate to the length of the gap to be covered. As shown in FIG. 1, the extrusions that define the rails 22, 24 are of different cross-sectional shapes. This is for illustrative purposes only; in practice, both rails would normally have the same cross-sectional shape. For reasons that will be explained later, rail 22 is the preferred shape; in FIG. 3 both rails are the same (rail 22).

Figure 3:
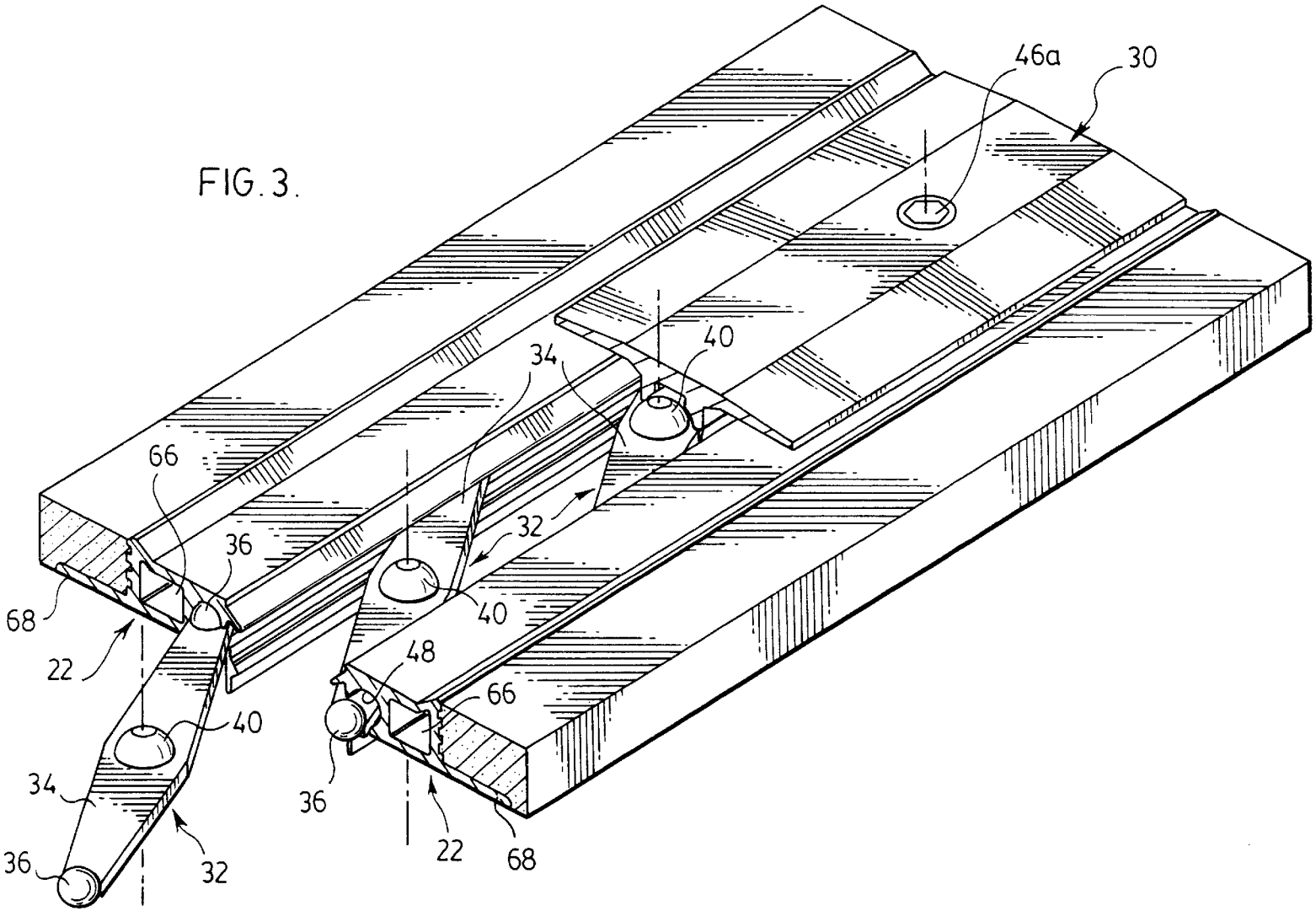

A plurality of turnbars are carried by the cover plate 30 and are coupled to the respective rails 22, 24 for maintaining the cover plate centred over the gap G. Only one of the turnbars is visible in FIG. 1 and is denoted by reference numeral 32. In FIG. 3, part of the cover plate 30 is broken away to show three typical turnbars 32. Two of those bars are shown extending partially outwardly from the rails 22, 24, again for illustrative purposes only; the turnbars would never extend outwardly of the rails in normal use of the expansion joint.

Figure 2:
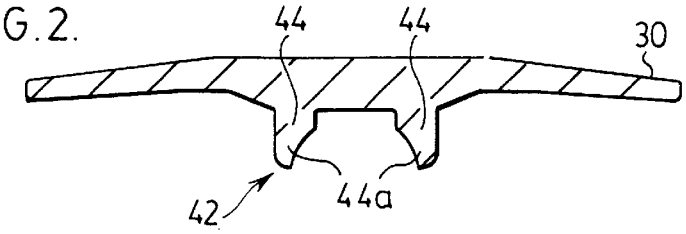
FIG. 2 is a vertical sectional view through the cover plate of the expansion joint; and, FIG. 3 is a perspective view of the expansion joint, partly broken away to show internal structure.

Reverting to FIG. 2, it will be seen that each turnbar has a main elongate body portion 34 with respective formations 36 at its ends, which are enlarged with respect to body 34. These enlarged end portions are coupled to the respective rails 22, 24 for sliding movement longitudinally of the rails in response to lateral movement of the slabs S (to narrow or widen the gap G). Each turnbar also defines a pivot axis A—A between the enlarged end portions 36 about which the turnbar turns with respect to the cover plate 30 during such movement.

In FIG. 3, the turnbars 32 are shown angled with respect to the rails 22, 24. If the slabs move towards one another, the angular inclination of the turnbars 32 with respect to the rails 22, 24 will become more acute as the turnbars pivot about their respective axes A—A. Conversely, if the slabs move apart, the angular inclination of the turnbars will become less acute.

Each of the turnbars 32 is coupled to the cover plate 30 by a ball and socket coupling 38 which in this case comprises a ball 40 on the turnbar and a socket 42 on the cover plate. As best seen in FIG. 3, the ball is a generally hemispherical formation and the main body 34 has a generally flat plate-like shape. The socket, on the other hand, is formed by respective ribs 44 at the underside of the cover plate that have arcuate surface portions 44*a* corresponding to the curvature of the ball 40. Because the cover plate 30 is an extrusion, the socket 42 engages the ball 40 only at the sides, i.e. in directions transverse to the length of the gap G. Nevertheless, since the concern is to transfer lateral loads from the cover plate 30 to the turnbars, this form of socket accomplishes the desired objective; it is unnecessary to provide what might be called a "full" socket that encircles the ball (though this certainly could be done in other applications).

In the illustrated embodiment, the turnbar 32 is coupled to the cover plate 30 for turning about axis A—A (and located longitudinally with respect to the cover plate) by a pivot element in the form of a bolt 46 that extends down through the cover plate and is threaded into a complimentarily threaded bore in the turnbar. The bolt head is shown at 46*a* and is located within a recess in the top surface of the cover plate 30. A washer 47 is used under the bolt head to allow head-to-cover plate movement. A rivet could be used as an alternative form of pivot element.

The illustrated design has the advantage that the spacing between the turnbars can be set simply by drilling holes through the cover plate 30 at appropriate locations. For example, in high traffic areas, it might be appropriate to have turnbars that are very closely spaced, while wider spacings might be acceptable for less travelled locations. That advantage would be lost if the ball and socket arrangement were reversed and the ball provided on the cover plate and the socket on the turnbar, though that certainly is a possibility within the broad scope of the invention.

The formations 36 that define the enlarged end portions of the turnbars preferably are spherical and are located generally in line with the centreline of the main body 34 of the turnbar, again so that lateral loads imposed on the turnbar are transferred directly to the formations 36. The turnbars are one-piece metal (aluminum) castings, but could be made in more than one piece, of more than one material and not necessarily cast. For example, the formations 36 and ball 40 may be made of separate components and assembled to the main body 34 of the turnbar.

Each of the rails 22, 24 shown in the drawings has a cross-sectional shape that includes a generally circular section undercut channel 48 that extends longitudinally of the inner face of the extrusion, i.e. so that the channels face one another. The channels 48 and formations 36 are sized relatively closely so as to minimize free movement therebetween. Above the "mouth" of each channel is a downwardly directed pointed formation 50 that provides a "drip" point for any moisture that may penetrate below the cover plate. The tip of each drip point 50 is positioned sufficiently inwardly of the inner edge of the respective slab so that any moisture drips into the gap and does not tend to migrate between the rail and the slab. Since the rails are extrusions, the drip edges 50 extend the full length of the gap.

A water stop or trough 52 is installed in the gap G between opposing faces of the two slabs S. The water stop itself is essentially a conventional elastomeric moulding that is secured to the respective slabs by bolts 54 that are driven into the slabs. Behind the head of each bolt is a retainer element 56 that is continuous along the length of the gap and includes a lip 56*a* that laps over the corner of the slab adjacent the relevant rail.

Outwardly of the respective channels 48, the two rails 22, 24 have different profiles. Rail 24 has a lower limb 58 that lies on the bottom surface of the rabbet 28 and through which the extrusion is secured to the slab by concrete anchors 60. An upper limb 62 of the extrusion is angled upwardly and away from channel 48 so that a cavity having a generally C-shaped inner wall 64 is defined above the concrete anchors. This cavity is filled with elastomeric concrete to complete installation of the expansion joint. While the C-shaped configuration of the inner wall of the cavity may be beneficial in that it allows the elastomeric concrete to "key" into the extrusion, there may also be a risk of air pockets developing as the elastomeric concrete is installed. Accordingly, the configuration of rail 22 may be preferred.

Referring now to rail 22, it will be seen that the extrusion defines outwardly of channel 48 what is essentially a closed cavity 66 (as seen in cross-section) from which extends outwardly a bottom limb 68 similar to limb 58 of extrusion 24, and through which the rail 22 is secured to the slab by concrete anchors.

A face 70 of the extrusion extends generally vertically upwardly from limb 68 adjacent the heads of the concrete anchors and includes grooves 72 that provide a key for the elastomeric concrete. Thus, face 70 defines with the rabbet 26, a generally rectangular section cavity 74 that can be directly filled with elastomeric cement with virtually no risk of air pockets developing. As noted previously, air pockets can lead to poor bonding of the elastomeric cement to the extrusion and/or slab and consequent risk of water infiltration. Another advantage of this form of extrusion is that the cavity 66 essentially reduces the volume of cavity 74, so that less elastomeric concrete is required.

In summary, the expansion joint provided by the invention presents a number of advantages as compared with the prior art. A primary advantage is that lateral loads imposed on the cover plate 30 are transferred directly to the turnbars 34 and from there into the relevant rail 22 or 24 and into the slab on which the extrusion is mounted. The risk of shear failure between the cover plate and the turnbars is minimized. At the same time, extrusion 22 in particular provides for secure bonding of elastomeric cement to the rail 22 and slab, reducing the risk of water infiltration. The drip edges 50 ensure that any water that does infiltrate between the cover plate 30 and the rails 22, 24 will be directed into the water stop 22 where it can be controlled and directed appropriately.

It is of course to be understood that the preceding description relates to a particular preferred embodiment of the invention only and that many modifications are possible within the broad scope of the invention. Some of these modifications have been mentioned previously and others will be evident to a person skilled in the art. It should be noted in particular that extrusions of either form shown in the drawings may be used as part of other expansion joints, for example joints that do not include the ball and socket couplings of the present invention.

I claim:

1. An expansion joint for installation across a gap between adjacent slabs of a structure intended to carry vehicular traffic, the joint comprising first and second rails for mounting on the respective slabs at opposite sides of the gap, a cover plate dimensioned to overlie the respective rails and cover the gap while permitting relative movement between the slabs, and a plurality of turnbars carried by the cover plate and coupled to the respective rails for maintaining the cover plate centred over the gap, wherein each turnbar has end portions that are coupled to the respective rails for sliding movement longitudinally of the rails in response to relative lateral movement of the slabs, and defines a pivot axis between said end portions about which the turnbar turns with respect to the cover plate in response to such relative movement of the slabs, and wherein each turnbar is connected to the cover plate by a ball and socket coupling comprising a socket on one of the turnbar and cover plate and a ball on the other of the turnbar and cover plate, said ball and socket being complimentarily shaped so as to allow turning of the turnbar with respect to the cover plate about said axis while transferring lateral loads imposed on the cover plate in use directly to the turnbar and into the relevant slab via the rail mounted on said slab.

2. The expansion joint as claimed in claim 1, wherein the ball is provided on the turnbar, and wherein the cover plate is an extrusion having longitudinally extending ribs which are shaped to embrace the ball and provide said socket, said ribs embracing side portions of each ball so that lateral loads on the cover plate are transferred to the ball via the ribs when the expansion joint is in use.

3. The expansion joint as claimed in claim 2, wherein each turnbar is coupled to the cover plate for turning about said pivot axis by a pivot element that extends downwardly from the cover plate between said ribs and into the turnbar through the ball.

4. The expansion joint as claimed in claim 3, wherein the pivot element for each turnbar comprises a bolt that is threaded into a bore in the turnbar, the turnbars being selectively positionable longitudinally of the cover plate in assembling the expansion joint by drilling holes through the cover plate to receive the bolts at locations required for the turnbars.

5. The expansion joint as claimed in claim 1, wherein each said turnbar comprises an elongate main body portion through which said pivot axis extends, and wherein said end portions are of spherical shape and are located at opposite ends of and in line with the main body portion so that lateral loads imposed on the turnbar are transmitted directly into said enlarged end portions of the turnbar, and wherein said end portions of the turnbar are received in complimentarily-shaped undercut channels that extend longitudinally of the respective rails for transmitting said loads into the rails and from there into the respective slabs in use.

6. The expansion joint as claimed in claim 5, wherein said turnbars are one-piece metal castings.

7. The expansion joint as claimed in claim 5, wherein each said rail is an extrusion having an inner portion defining said undercut channel for receiving said enlarged end portions of the turnbars, a drip lip that extends longitudinally of the extrusion inwardly of the undercut channel and is positioned so that, when the rail is installed on a slab, the lip is located in the gap between that slab and an adjacent slab, the extrusion further including an outer portion having a bottom limb by which the rail can be secured to the slab, the extrusion defining an open area above said limb for receiving elastomeric concrete for bonding the rail to the slab.

8. The expansion joint as claimed in claim 7, wherein the rail extrusion is shaped to define a closed cavity as seen in cross-section between said limb and said undercut channel, and a face that is disposed generally at right angles to and above said limb for defining with said limb and with faces of a recess in the slab in which the rail is located, a generally rectangular cavity for receiving elastomeric concrete.

9. The expansion joint as claimed in claim 8, wherein said face that extends generally at right angles to said limb is provided with a series of grooves for keying to elastomeric concrete, and wherein said closed cavity is generally rectangular.

* * * * *